US007942354B2

(12) United States Patent
Didion

(10) Patent No.: US 7,942,354 B2
(45) Date of Patent: May 17, 2011

(54) ROTARY TUMBLER AND METAL RECLAIMER

(75) Inventor: Michael S. Didion, St. Charles, MO (US)

(73) Assignee: Didion Manufacturing Company, St. Peters, MO (US)

( * ) Notice: Subject to any disclaimer, the term of this patent is extended or adjusted under 35 U.S.C. 154(b) by 21 days.

(21) Appl. No.: 12/460,524

(22) Filed: Jul. 21, 2009

(65) Prior Publication Data

US 2010/0025508 A1 Feb. 4, 2010

Related U.S. Application Data

(60) Provisional application No. 61/137,258, filed on Jul. 29, 2008.

(51) Int. Cl.
*B02C 13/00* (2006.01)
*B22C 19/00* (2006.01)

(52) U.S. Cl. ..... 241/74; 241/81; 241/91; 241/251; 241/261.1; 241/299; 241/DIG. 10

(58) Field of Classification Search ..... 241/74, 241/79.3, 81, 91, 251, 261.1, 299
See application file for complete search history.

(56) References Cited

U.S. PATENT DOCUMENTS 788,675 A * 5/1905 Rissmucier ..... 241/252
2,050,458 A * 8/1936 Ovestrud et al. ..... 209/17
2,523,258 A * 9/1950 Ransohoff ..... 451/328
2,751,115 A 6/1956 Kindseth
3,454,230 A 7/1969 Allen
3,998,262 A 12/1976 Didion
4,154,290 A * 5/1979 Weststrate et al. ..... 164/404
4,674,691 A 6/1987 Didion
4,688,727 A * 8/1987 Sijsling ..... 241/56
4,981,581 A 1/1991 Didion
5,016,827 A 5/1991 Didion
5,095,968 A 3/1992 Didion
5,108,584 A 4/1992 Brosseuk
5,267,603 A 12/1993 Didion
5,291,714 A 3/1994 Wright et al.
5,613,902 A 3/1997 Didion et al.
5,628,126 A 5/1997 North
5,638,890 A 6/1997 Didion et al.
5,794,865 A 8/1998 Didion et al.
6,000,645 A 12/1999 Preisser
6,273,176 B1 8/2001 Didion
6,896,400 B2 5/2005 Didion
7,204,636 B2 4/2007 Didion
7,712,691 B2 * 5/2010 Sharp ..... 241/65

* cited by examiner

*Primary Examiner* — Faye Francis
(74) *Attorney, Agent, or Firm* — Paul M. Denk

(57) ABSTRACT

A rotary tumbler metal reclaimer includes an inner cylinder and a concentric outer cylinder that rotate simultaneously. The inner cylinder includes a first compartment that intakes material for breaking by teeth, a second compartment that receives broken material from the first compartment and crushes the material into smaller particles, and a third compartment wherein particulate material enters the space between the inner cylinder and the outer cylinder by attrition through perforated screens. The second compartment includes a crusher having various features for crushing lump material as it rotates. The third compartment provides further breakage and conveyance of particulate material. Particulate material then returns proximate the intake for screening into fine and coarse sizes and then collecting for reuse. Metallics and metallic oxides exit the tumbler through apertures in the rear of the third compartment for collection. The tumbler reclaims metals, metallic oxides, sands, and other materials for reuse.

8 Claims, 2 Drawing Sheets

ROTARY TUMBLER AND METAL RECLAIMER

CROSS-REFERENCE TO RELATED APPLICATION AND PATENTS

This application claims priority to the provisional application having Ser. No. 61/137,258 filed Jul. 29, 2008. The subject matter of this application is related to the subject matter of the patents of Michael S. Didion and Charles J. Didion, pertaining to Interlocking Liner for a Casting Shake Out Unit, now U.S. Pat. No. 6,273,176, and Interlocking Liner for a Casting Shake Out Unit, now U.S. Pat. No. 5,638,890, and both owned by a common assignee.

BACKGROUND OF THE INVENTION

This invention relates to casting shake-out units used to separate or remove metallics from castings, slag, and dross, in a foundry, a mill, or other works, and in particular, to a rotary tumbler having helices of spaced blades and serrated blades in the attrition chamber.

In the formation of a tumbling mill, such as a casting shake-out unit, rotary separator, media drum, material drier, lump crusher reclaimer, blending drum, sand screen, or the like, the mill has generally three chambers: an intake chamber, a crushing chamber, and an attrition chamber. The intake chamber, or first compartment, receives raw castings and conglomerations from a foundry or other process. The raw castings and the like enter the intake by dumping or direct flow from a preceding process. Inwardly into the machine from the intake chamber, a crushing chamber, or second compartment, receives castings and conglomerations partially broken up by the intake.

The second compartment has a crushing means that rotates independently of the machine and rolls upon the inside surface of the machine. The partially broken up castings and conglomerations pass alongside and then under the crushing means for further reduction and separation.

Behind the crushing chamber and generally opposite the intake chamber, an attrition chamber, or third compartment, separates the metallic castings from sand and other particles. The attrition chamber collects the sand and other particles from the inside of the machine and returns them towards the intake chamber in a passageway between the outer cylinder and the inner cylinder. The attrition chamber has within it serrated toothed lifters spaced apart upon interlocking plates with holes. The lifters, at a high tumbling rotation, separate dross, slag and salt cake readily to liberate and to clean metallics and metallic oxides. Helical vanes within the attrition chamber guide metallics and metallic oxides towards an exit opposite the intake chamber while sweeping dross and sand through the attrition chamber to fall into the holes and then the passageway for removal.

There are a variety of machines and apparatuses upon the market and in use that are applied for reducing lump material to a usable consistency. For instance lumps of sand that are generally chemically bonded together just after being broken from the mold or casted part used in the casting industry can be reduced to a granular texture for its immediate reuse in the formation of a mold for further casting.

A unique aspect of the present invention is helically arranged blades in the intake chamber that both break apart lumps and advance the resulting broken materials into the rotary tumbler for further gradation and sorting. The blades are spaced apart from one another and each blade has flutes lengthwise upon its inside edge. The rotary tumbler also has a crusher that occupies the volume of the crushing chamber and has spaced apart teeth upon the leading edge of the crusher. After the crusher, helical vanes pass material through the attrition chamber and along past spaced apart blades that further separate metallics from lumps of sand and dross. These blades are spaced apart from one another and have a serrated inside edge.

DESCRIPTION OF THE PRIOR ART

There are a variety of apparatuses and machines available for aiding in the separation of embedded core and cling sand that holds onto and remains in a casting after it is molded. These devices eliminate the need for a laborer to spend excessive hours cleaning the casting by hand. Other patents of the inventors show various related drums and rotary mills developed over the years. Such devices are readily shown in our earlier U.S. patents, for example, U.S. Pat. No. 3,998,262; No. 4,674,691; No. 4,981,581, No. 5,016,827; No. 5,095,968; No. 5,267,603; and, No. 5,794,865. These patents disclose casting shake out units used to remove casting sand from a formed casting by tumbling the casting. In another embodiment, sand is removed from castings by abrasive members that also aid in the deburring of the casting. All of these prior units as disclosed in the patents operate successfully to clean and to deburr castings. They have saved foundries many hours of labor previously required in the processing of fresh castings and achieved extensive commercial acceptance. Although our prior patents provide a means for separating cling sand from castings, a need exists for reclaiming metallics, sand, and other lump material as described above. Other ones of our patented embodiments take sand and reclassify it after its processing, following the green sand's use in forming of a mold during casting. In addition, means are provided for reclaiming lump material, i.e. lump material of sand, for further grading, to be used in preparation for reuse in the casting of metal parts.

Within a tumbling mill, various plates, or segments, grade and sift metallics and sand. The segments have a plurality of holes of various diameters for removing sand and then metallics. In U.S. Pat. No. 6,273,176, a plurality of T shaped pins engage grooves in the edges of segments. The pins lock adjacent segments to one another and prevent shifting of segments during wear.

In U.S. Pat. No. 5,638,890, a liner segment has three vanes upon the outer surface and a diagonal vane upon the inner surface. The liner segment has cooperating tongues and pockets to inter connect adjacent offset liner segments.

The present art overcomes the limitations of the prior art. That is, the art of the present invention, a rotary tumbler and metal reclaimer, uses helices of spaced apart fluted and toothed blades to break metallics from slag, dross, and sand, for further gradation and sorting with minimal downtime and greater weights of metallics recovered from casting wastes.

SUMMARY OF THE INVENTION

A tumbling unit, such as a casting shake-out unit, rotary media drum, sand reclaimer or the like, includes a cylindrical outer shell and a concentric cylindrical inner shell. The inner cylinder has a liner formed of a series of interfitting segments. The tumbling unit or rotary media drum reduces lump material into particulate material suitable for reuse and recycling in industrial processes. The drum includes an inner cylinder and a concentric outer cylinder which at one end extends beyond the inner cylinder to form an intake compartment of larger diameter to receive the lump material. A laser aligned base incorporates a drive means supporting the drum and driving the drum, which is substantially horizontally disposed, in rotation.

An intake chamber, or first compartment, receives the lump material and it has a diameter as large as or larger than the remainder of the outer cylinder. The intake chamber also contains high profile teeth arranged helically which advance the lump material through the first compartment towards a crushing chamber in the inner cylinder. The first compartment of the inner cylinder contains means for breaking the lump material into smaller pieces and for sorting reclaimed sands and other aggregates. The preferred means for breaking the lump material into smaller pieces is a combination of blade. The first compartment preferably also contains in a first segment, teeth or vanes, to advance the lump material obtained from the intake compartment into the crushing means of the second compartment. The crushing means advances the smaller pieces obtained in the first compartment to an attrition chamber.

The attrition chamber has at least a partially perforated cylinder wall where high tumbling action further reduces the size of the pieces to particulate matter so at least a portion of the material passes through the perforations. Any material not passing through the perforations leaves the attrition chamber through an exit for metallics. In addition, a conveying vane is provided intermediate the inner and outer cylinder for movement longitudinally of any particulate matter deposited therein to a set of screens proximate the intake for further finer classification of the particles. Any matter remaining on the screen is recycled to the intake compartment for redeposit into the machine for further crushing. The apparatus of the present invention is suitable for reducing the size of lump material, both sands and metallics, to particulate matter of a predetermined size.

The present invention utilizes a rotary lump crusher/sand reclaiming drum for reclaiming lump materials. As shown in the prior art, a rotary media drum reclaims core sands and metals from metal castings. However, the present invention extends the use of the rotary media drum for processing a variety of lump sand materials including aggregates, chemically bonded sand lumps, dross, ferrous and non-ferrous scrap, and slag. Conventionally, material entering a rotary media drum is fed into one end of the drum by use of a conveyor, shovels, a load hopper, a vibratory conveyor or any desirable means for placing a large amount of material into the entry of the rotary-sand lump processing drum. Previously, the lump material, when entering the drum in large quantities, tended to clump resulting in surges when the material reached the second compartment in the inner cylinder which contains means for crushing the lump material into smaller pieces. Through an extension of the outer cylinder beyond the inner cylinder to form an intake compartment of larger diameter, the material to be passed through it may be placed into the intake compartment in batch quantities for distribution in such a manner as to prevent surges of lump material from cumulatively reaching the first compartment. The intake compartment has high profile segmented helical teeth to advance the lump material from the intake into the first compartment. The high profile segmented helical teeth allow the clumps of lump material to separate sufficiently to provide a more uniform flow of material into the first compartment. The first compartment also includes screens outwardly of the inner cylinder for separating the sands and metallic oxides into coarse and fine grades that are then collected in separate bins.

The first compartment of the inner cylinder breaks up and separates lump material into small pieces. The lump material breaks into smaller pieces upon teeth, blades, spikes, or the like protruding inwardly from the inside of the inner cylinder. As the material strikes these blades or spikes, the lumps are reduced in size and provide pieces of material suitable for further treatment and reduction in size into particulate type matter. Upon the inward end of the first compartment, a disc having certain features guides the broken material into the second compartment. The disc spans the diameter of the inner cylinder. The disc has an inner opening with a plurality of teeth pointing inwardly. The inner opening has a diameter in excess of the suspension means for the second compartment as later described. Upon the perimeter, the disc has spaced apart arcuate slots, at least three in number. Each slot has a width and the spacers between adjacent slots have a length similar to the width of the slot. Beyond the disc, the strained material enters the second compartment of the invention.

Within the second compartment, another means suitable for breaking the lumps is a crusher located within the apparatus. In a preferred embodiment, a heavy crusher is disposed for rotation within the second compartment through its pivotal mounting to a flexible suspension means. The suspension means holds the crusher at one end and the crusher, which is arranged generally longitudinally within the apparatus, revolves within the apparatus upon its bearing support. The lumps, gradually fed and delivered to this compartment, are substantially broken down through pressure, weight and shock when forced under the crusher to subject the material to the enormous weight of the crusher. Such a device is usually metallic and formed for mashing any lumps to a significantly reduced size.

The crusher, rotatably mounted in a flexible manner upon chain supports extending in equally spaced directions, turns by gravity with respect to its suspension means through the rotation of the inner cylinder which is subjected to turning by means of an external drive means, such as a motor. The flexibility and support of the crusher by the chain suspension provides for play in the turning of the crusher so that the lumps of material and any other extraneous material accumulated within the drum can be gradually shifted to the vicinity of the crusher and forced under that segment of the crusher that is arranged longitudinally in proximity and aligned with the contiguous surface of the inner cylinder. In this invention, the crusher has a plurality of spaced apart teeth upon its head slightly away from the chain suspension. The teeth extend down a conically shaped head of the crusher to a rounded base. Alternatively, the teeth have a helical arrangement to urge material around and rearward along the crusher. Outwardly from the base and opposite the head, the crusher has a truncated conical tail. The tail has a plurality of spaced apart longitudinal slots and intermediate ribs. The ribs and slots cooperate to urge crushed material rearward from the crusher to the attrition chamber. In this invention, the base of the crusher has a diameter approximately that of the inner cylinder.

The materials as reduced to smaller pieces then exit the second compartment in the inner cylinder and are transported to an attrition chamber immediately adjacent to and coaxial with the second compartment of the inner cylinder. The attrition chamber, having at least a partially perforated cylinder wall, provides high tumbling action to further reduce the size of the remaining lump pieces so as to pass some of the granular material through the perforations to further the reduction and transfer of the pieces of particulate matter for separated collection. The attrition chamber may have blades or teeth or to reduce the pieces of material to particulate matter, a substantial portion of which passes through the perforations of the inner cylinder of the attrition chamber. The attrition, or third compartment, includes a major vane in a continuous helix that guides reduced materials rearward through the attrition chamber. The major vane passes between spaced apart teeth. Alternatively, the teeth in the attrition chamber have a plurality of serrations upon their inward edge.

The particulate matter passing through the perforations from the attrition chamber passes into the space between the inner cylinder and the outer cylinder. The space between the inner cylinder and the outer cylinder is provided with a conveying vane which moves the particulate matter longitudinally in the desired direction, depending upon the direction of orientation of said vanes. Here, the conveyor vane allows the material to move toward the intake compartment, in the opposite direction of flow of material undergoing crushing within the inner cylinder. In the illustrated embodiment of the present invention, the reduced particulate matter moves forward to at least two screens where the matter is classified, the smaller material falling through for collection into at least two bins, ducts, or conveyors, while the larger matter failing to pass through the screen, also known as screenovers, is returned into the intake compartment. The classification screens may consist of a metal sheet with perforations, or a multiplicity of sheets or screens of varying sizes, or one or more wire mesh screens, so as to separate and reclassify the particulate matter into more than one size.

The material, generally metallics, which did not pass through the perforations in the attrition chamber for further tumbling and crushing by the blades, continues through the attrition chamber and eventually leaves through an exit provided for metallics. The rotary lump crusher/reclaimer of the present invention is disposed substantially horizontally to permit rotation. A base means supports the drum and provides a drive means for driving the drum at the desired speed of rotation.

Therefore, it is an object of the invention to provide a new and improved rotary tumbler metal reclaimer.

It is a further object of the present invention to prevent the accumulation of metallics, sand, dross, slag, salt cake, by-products, and other castoffs at the meeting of two blades and hence a chokepoint impeding the flow of materials out of drum.

It is a further object of the present invention to prevent rocking of the drum due to uneven wear of the blades and crusher.

It is a further object of the present invention to provide for ready exchange of teeth or blades following ordinary wear or an impact event.

It is a further object of the present invention to increase the metallics reclaimed and sand handled per hour of operation of the tumbler by at least 5% over existing machinery.

It is a further object of the present invention to provide the lowest operating cost of the tumbler per ton of metallics recovered.

It is a further object of the present invention to feed, crush, clean, separate, and screen rigid lumps of foundry waste into recovered metallics.

It is a further object of the present invention to cause positive crushing action upon the lumps in the crushing chamber using a dynamically isolated mulling roller that directs the energy of the crusher into the dross but not into the tumbler hull.

It is a further object of the present invention to utilize an autogeneous milling chamber having high tumbling action that further separates metallics from dross and other materials yielding more tons per hour.

It is a further object of the present invention to automatically recirculate screenovers for two passes beneath the mulling roller or crusher providing higher output of metallics and thus avoiding usage of a ball mill.

It is a further object of the present invention to contain dust and heat within the invention using a single point connection of ductwork thus avoiding installation of a hooding and ventilating system.

It is a further object of the present invention to efficiently air wash from the invention to maximize the dust separated and removed from the metallics.

It is a further object of the present invention to readily separate metallics from dross and then meter each from opposite ends of the rotary tumbler for further processing.

It is a further object of the present invention to operate the rotary tumbler either in batch or continuous modes of loading.

It is a further object of the present invention to locate the rotary tumbler upon a unitized base frame and limited foundation thus reducing installation costs.

It is a further object of the present invention to have a rotary tumbler with the lowest maintenance cost per ton.

It is a further object of the present invention to have a rotary tumbler with the lowest operating cost per ton including no requirement for compressed air supply or combustion fuels. The operating cost decreases through use of standard drive components within an accessible unitized frame.

It is a further object of the present invention to operate the rotary tumbler level upon laser aligned main support bearings thus reducing wear upon the riding rings, wheels and bearings.

It is a further object of the present invention to increase the concentration of metallics recovered per ton of input for a faster payback upon the cost of the rotary tumbler.

It is a further object of the present invention to lessen the disposal waste stream tonnage and volume.

And, it is a further object of the present invention to reduce power consumed, flux required, and melting costs in operating the rotary tumbler of the present invention even during periods of continuous use.

These and other objects may become more apparent to those skilled in the art upon review of the invention as described herein, and upon undertaking a study of the description of its preferred embodiment, when viewed in conjunction with the drawings.

BRIEF DESCRIPTION OF THE DRAWINGS

In referring to the drawings.

The same reference numerals refer to the same parts throughout the various figures.

DESCRIPTION OF THE PREFERRED EMBODIMENT

Figure 1:
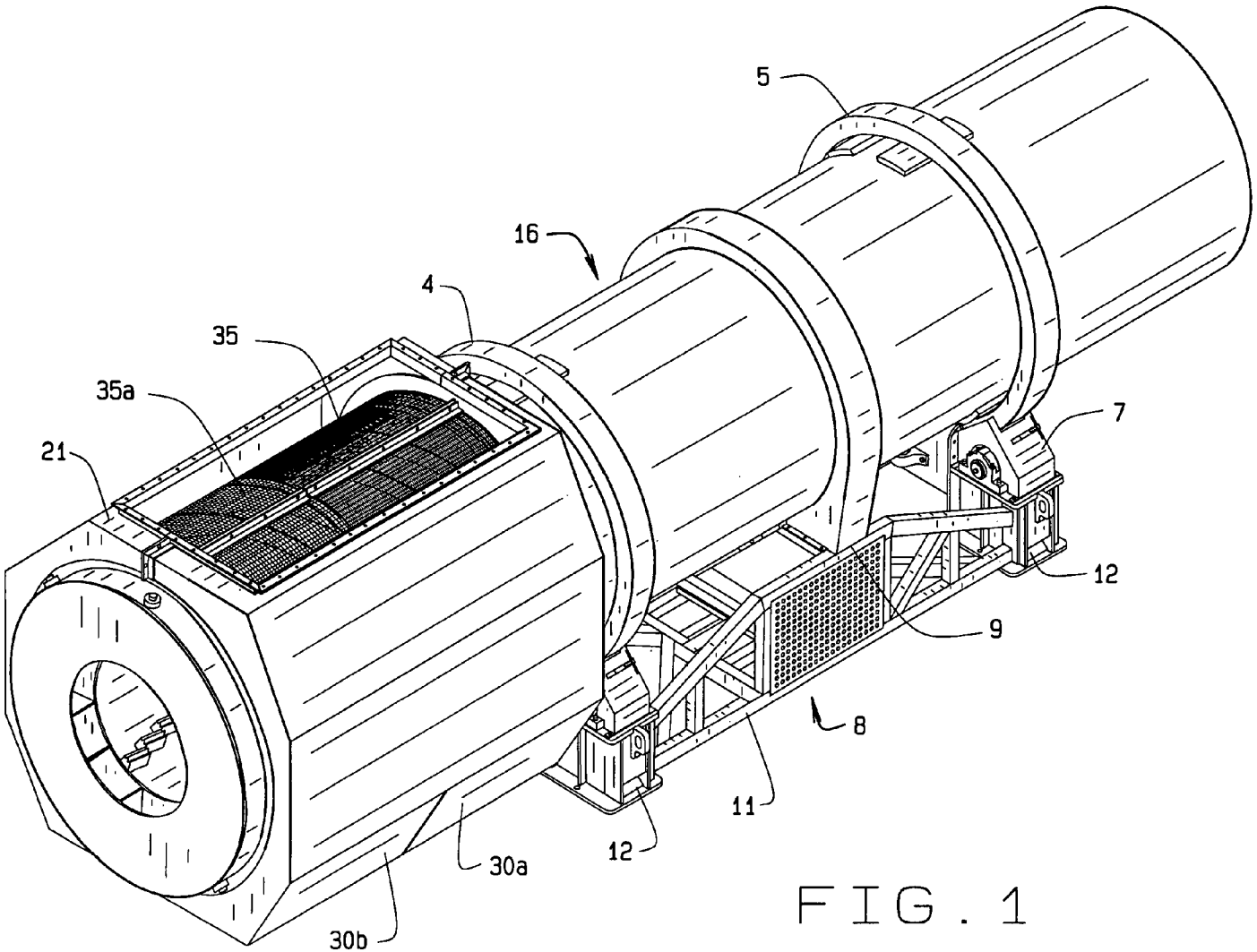
FIG. 1 is an isometric view of a rotary tumbler of the present invention, often used as casting shakeout unit; and, FIG. 2 is an isometric view which is partially in sectioned to show the interior components of the present invention.

The present art overcomes the prior art limitations by providing additional lump crushing devices. The following detailed description illustrates the invention by way of example and not by way of limitation. This description will clearly enable one skilled in the art to make and use the invention, and describes embodiments, adaptations, variations, alternatives and uses of the invention, including what is presently believed to be the best mode of carrying out the rotary tumbler metal reclaimer 1, shown generally in FIG. 1.

Figure 2:
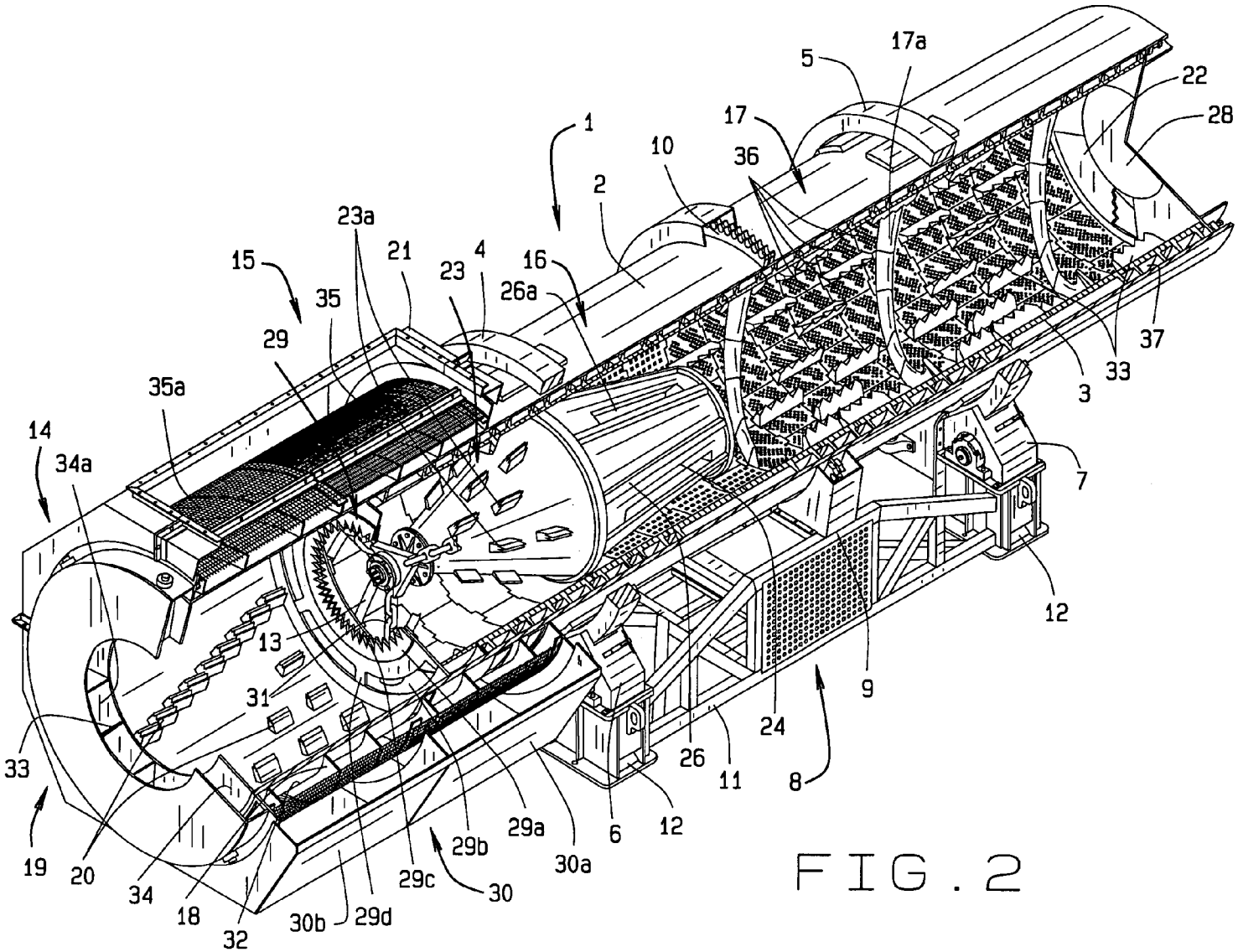

The rotary tumbler 1 is preferably a tumbler constructed and operated as a mill in the manner previously disclosed in U.S. Pat. No. 3,998,262 to remove sand from castings by tumbling them. With respect to FIGS. 1, 2, a rotary tumbler metal reclaimer 1 is provided with an outer cylinder 2 and an inner cylinder 3. The inner cylinder has a smaller diameter than the outer cylinder, and the two cylinders define a space between them for conveying particulate material as later described. The outer cylinder is provided with an intake compartment 14 wherein lump material, to be processed, is placed into the rotary material crushing drum 1. The intake compartment 14 contains helical teeth 20 which are of sufficiently high profile to enable large clumps and lumps of material to be initially separated into smaller lumps of material which are somewhat uniformly distributed on the inner surface of the intake compartment 14. The intake compartment 14 which has received material through the intake area 19, the latter of which comprises an opening in the end of the rotary drum 1, conveys the material by the helical teeth 20 forward into the first compartment 15 whereupon the material is further handled by helical vanes or rifling 13. The first compartment 15 and the adjacent second compartment 16 contain the feeding section with the helical vanes 13 and a later described crushing and grinding means 23 respectively. The second compartment begins at a suspension means 29 and with a disc 29*a*, later shown in FIG. 2. The disc occupies the inner cylinder and has a central opening framed by inwardly pointing teeth 29*c*. The central opening admits lump material past the teeth and into the crushing means. Outwardly from the teeth 29*b*, the disc has a plurality of partially annular slots 29*b*. The slots are adjacent to the inner cylinder and allow lump material less than the height of the slot to pass through to the crushing means. The disc separates adjacent slots using struts 29*d* generally having a width proportional to the height of a slot.

The crushing and grinding means 23, incorporating spaced teeth 23*a*, is anchored in the compartment 16 by a suspension means 29, behind the disc, having chains fastened to the inner wall of the compartment. The crushing means 23 is substantially cylindrically shaped, albeit formed as a tapered cylinder having longitudinal ribs 26, that extend along the length of the segments of crusher 24. As later shown in FIG. 2, the crusher has a head, generally connecting to the suspension means and having a frusto-conical shape, and an opposite tail, including the ribs, having an elongated conical shape. The head has a plurality of spaced teeth 23*a* arrayed parallel to the direction of flow of material and alternatively, the teeth have a partially helical arrangement. The tail of the cylinder also has a plurality of slots, 26*a*, generally adjacent to alternate ribs. The crushing means 23 is generally a heavy metallic drum-like entity rotatably mounted to a suspension means 29, which functions as a bearing, and which permits the crushing means 23 to rotate by gravity due to the rotation of the cylinders. The crusher generally occupies nearly the entire inside diameter of the inner cylinder. As rotation occurs, the lump material passes along the second compartment thus entrapping lump material beneath the crusher so as to squash, crush, and substantially reduce in size the lump material due to the shape, weight and extensive length of the crushing means 23.

The crushed material, reduced in size, is passed to the third, or attrition, chamber 17. The attrition chamber 17 contains apertures 36 in the inner cylinder wall which permit material sufficiently small in size to be classified to pass through the apertures 36. In addition, the attrition chamber 17 contains blades 33 which assist in further reducing the size of the crushed material received in the attrition chamber 17 from the crushing means 23. The blades lift and drop the granular and lump material. At least one helical vane, 17*a*, guides and urges lump and granular material rearward through the attrition chamber. Any metallic material which is not reduced to a size sufficient to pass through the apertures 36, exits through an opening for metallics, as at 22, for further use and reuse. The tumbler 1 further includes an inspection door, as at 28, opposite the intake for use during operations and maintenance of the tumbler.

The particulate matter which passes through the apertures 36 is deposited in the space between the outer cylinder 2 and the inner cylinder 3. Within the space is a continuing conveyor means in the form of helical vanes 37 which sweep the material toward the intake compartment 14, in the opposite direction of material undergoing crushing within the inner cylinder. The material exits at an exit port 32 onto first, a fine screen 35. The screen forms the outer portion of the intake compartment. Helical vanes 18 are located between the fine screen 35, a second or coarse screen 35*a*, and the surface of the intake compartment 14. The helical vanes 18 sweep the surface of the screens 35, 35*a* to direct the particulate matter forward, over the screens for fine and coarse metallic oxides to collect, and then the material too large to pass through the screen goes in the direction of the material pick-up port 34. Thus, the extra large coarse material, or screenovers, is recycled by means of the exit port 34 into the intake compartment 14 for a second attempt at crushing and grinding. The material which passes through the screens 35, 35*a*, is deposited in the particulate matter collector 30 with sub-collectors for fine materials 30*a* and coarse materials 30*b*. Located above the intake compartment 14 is a dust collector 21. The dust collector does not rotate as part of the rotary media drum nor does the particulate matter collector 30 and sub-collectors 30*a*, 30*b*.

The outer cylinder 2 incorporates upon its external surface, a pair of spaced apart guides, tracks or races as at 4 and 5, which are positioned for riding or sliding upon roller bearings or guides such as can be seen at 6 and 7, the bearings being provided at either side of the apparatus and formed into the base means 8. The base means 8 supports the cylinder 2 and the entire apparatus 1 for rotation. A drive means, such as a motor, as at 9, is provided for cooperating with a sprocket 10 through any suitable inter-connecting gearing means as needed to provide for a controlled rotation of the outer cylinder 2 and its internally arranged components at a controlled speed generally within a range of 1 to 10 rpm. The base means 8 is formed of a series of struts as at 11 and generally is designed to be mounted upon shock absorbers such as 12 in order to dampen vibrations and to lessen the noise of operation of the apparatus.

The outer cylinder 2 extends substantially the entire length of the apparatus with the exception that at the outlet end opposite the intake 14, the tumbler has a door 28 for inspection of the invention by an operator or mechanic.

The outer cylinder 2 and the inner cylinder 3 are affixed to each other for simultaneous rotation of the rotary tumbler metal reclaimer. Certain optional modifications may be made to the inner cylinder. For instance, in the intake 14, apertures could be placed through its wall so that material small enough to be removed from the process at the beginning, could pass through the wall and to the screens 35, 35*a*. Similarly, in the first compartment 15, the inner cylinder could be provided with perforations to allow particulate matter to pass through into the region between the outer cylinder 2 and the inner cylinder 3 whereupon the matter would be transferred, as discussed earlier, onto the classifying screens 35, 35*a*.

To carry out the process of the invention, lump material is fed into the intake compartment 14 by equipment, a load hopper, or vibratory conveyor not shown in the drawing. Upon entrance of the material into the intake compartment, the lumps are regulated against surges because of the larger diameter of the intake compartment than any other portion of the apparatus where the inner cylinder 3 is present. The lump material is metered into the crushing compartment 16 by a combination of the teeth 20 in a helical arrangement in the intake compartment and the continuous helical vanes or ribs 13 in the first compartment 15. The crushing means 23 provides positive action to reduce large lumps that vary in size and hardness. The crushing means 23 is of substantial length and diameter and includes a segment, or tail, having a significant length as at crusher 24 which is generally arranged in contiguity with the bottom surface to the inner cylinder 3 and which may include a series of longitudinal-like ribs 26 and slots 26*a* so that material fed into this region will be substantially ground by means of the heavy weight of the roller to a much finer size. This crushing means is suspended upon its head towards one end and revolves upon its tail by gravity during rotation of the cylinder.

The entrance end, or head, of the crushing means includes a suspension means 29, as can be noted, for pivotal rotation within the inner cylinder 3 as a result of the rotation of the inner cylinder 3 during operations of the apparatus. The suspension means has the disc 29*a* shown before it. The disc occupies the inner cylinder and has a central opening framed by inwardly pointing teeth 29*c*. The central opening admits lump material past the teeth and into the crushing means. Outwardly from the teeth 29*c*, the disc has a plurality of partially annular slots 29*b*. The slots are adjacent to the inner cylinder and allow lump material less than the height of the slot to pass through to the crushing means. The disc separates adjacent slots using struts 29*d* generally having a width proportional to the height of a slot.

Moving rearward from the disc, the suspension means 29 has an integral bearing to permit rotation of the crushing means 23 at a different speed from that of the inner cylinder. The suspension means 29 incorporates a housing generally configured in a triangular, or other shape, and has linked to it at its apexes a flexible connecting means such as chains 31. The chains 31 are secured by means of connectors to isolated and reinforced parts of the inner cylinder 3 in order to suspend the upper pivotal end of the crushing means 23 approximately centrally but yet flexible in its mounting in the apparatus. In this manner, little interference is provided against movement of the lump material by means of the conveyor vane 13 into the vicinity of the second, or crushing, compartment 16. The lump material that passes through the lump crushing compartment 16 is reduced by means of the toothed crushing means 23 to a size which generally is then reduced in the attrition chamber to less than the size of the apertures in the attrition chamber 17. The crushing section provides a positive action in reducing large lumps to a much smaller size through the action of the crushing ribs 26 and adjacent slots 26*a*.

Following the foregoing procedure, the ground material is once again forced by the volume of additionally fed material, the helical vane 17*a*, or perhaps through a slight incline in the arrangement of the inner cylinder 3 into the region of the attrition chamber 17 where further particle reduction takes place. At this location, the inner cylinder 3 is perforated and those particle sizes, generally less than ¾ inch, pass into the space intermediate the outer cylinder 2 and the inner cylinder 3 and are moved by means of the continuous vane 37 further longitudinally along the apparatus returning in the direction of the intake compartment. That material, greater in size than the size of the apertures 36, is lifted by means of the blades 33, and is then dropped onto the surface of the inner cylinder for further breakage.

Following breakage, the smaller material, generally metallic oxides, passes between the inner cylinder and the outer cylinder to the screening section proximate the first compartment. In the event too many oversized particles accumulate in the attrition chamber 17, then when the depth is sufficient, the oversized material accumulates and may be removed through the door 28. The screens 35, 35*a* utilize punched plate or woven wire screen with openings to meet fine and coarse application specifications. The material is classified through a single or multiple screening system that automatically recirculates pieces that are larger than the specifications through the material pick-up exit 34. Apertures are provided through the wall 34*a* to allow the material to be returned. And, a dust collection hood 21 encloses the screening section in which a controlled velocity of air removes fines and classifies the material.

The rotation speed of the rotary tumbler and metal reclaimer of the present invention is usually from about 1 to about 10 rpm, preferably from about 4 to about 10 rpm depending on the particular application. The drum also can be run on a batch type basis.

As can also be seen for this application, the various sections of the inner cylinder may be fabricated of segmented components, as can be seen in our previous patents, and which are incorporated herein by reference, wherein the segments of the inner cylinder may be formed of a rectangular but arcuate shape, having a segment of a rib, or helix, integrally formed therewith, and likewise having a segment of a vane formed therewith so that when the sections are fabricated, through their interconnecting together as explained in the prior art, they form the uniform inner cylinder of this rotary lump crusher drum.

Special features include crushing, tumbling, scrubbing, screening and classifying in the one self-contained unit. Automatic screening recirculation and automatic debris removal or metallic discharge means are also provided and for which no operator is required. The inner cylinder of the structure may be at least partially formed of liner segments, as explained, such as showing in our previous patents.

From the aforementioned description, a rotary tumbler and metal reclaimer has been described. This tumbler is uniquely capable of reducing and separating metallics from slag, sand, dross, and oxides following metal making operations. This tumbler separates the metallics and slag, sand, dross, and oxides into different streams for reuse. This tumbler and its various components may be manufactured from many materials including but not limited to ferrous and non-ferrous metals, their alloys, polymers, high density polyethylene, polypropylene, nylon, and composites.

Variations or modifications to the subject matter of this invention may occur to those skilled in the art upon reviewing the development as described herein. Such variations, if within the scope of this development, are intended to be encompassed within the principles of this invention, as explained herein. The description of the preferred embodiment, in addition to the depiction within the drawings, are set forth for illustrative purposes only.

I claim:

1. A rotary tumbler and metal reclaimer drum for reclaiming and reclassifying metallics, metallic oxides, sands and related aggregates from lump materials, said drum being substantially horizontally disposed for rotation for reclaiming lump materials, comprising:

an inner cylinder having a first end and a second end opposite said first end, said inner cylinder forming a first compartment, a second compartment inward of said first compartment, and a third compartment inward of said second compartment and opposite said first compartment, said first compartment including an intake receiving lump material, said second compartment providing a crushing chamber, and said third compartment providing an attrition chamber;

an outer cylinder concentric with said inner cylinder, said outer cylinder extending beyond said inner cylinder at said first end of said inner cylinder forming said first compartment providing intake of lump material therein;

said intake compartment being of larger diameter to receive the lump material and having high profile spaced apart teeth arranged in helical flights, said teeth advancing the lump material without substantial surges through said first compartment, and said intake compartment having a diameter larger than the diameter of said inner cylinder;

said teeth of said first compartment breaking the lump material into smaller pieces and advancing the smaller pieces into said crushing chamber where the lump material is crushed into further smaller pieces, the smaller pieces of lump material then passing into the attrition chamber;

said crushing chamber including a slotted disc proximate the juncture of said second compartment with said first compartment; and a crusher behind said slotted disc and having a length of weighted material disposed for partially resting upon the inner surface of the inner cylinder, a head proximate said first section and an opposite tail generally resting upon said inner cylinder, said head including a plurality of high profile teeth spaced thereon, said tail including a plurality of longitudinal ribs thereon having alternating slots, said crusher being urged into rotation by turning of said inner cylinder, said head being pivotally suspended approximately centrally of the inner cylinder;

a suspension means pivotally holding said tail of said crushing means to the inner cylinder, said suspension means including a series of flexible links supporting said head of said crusher generally centered within said inner cylinder behind said slotted disc;

said attrition chamber having at least a partially perforated cylinder wall where high tumbling action further reduces the size of the pieces of the lump material to particulate matter so as to pass a substantial portion of the material through its perforations, a plurality of high profile teeth spaced apart in a generally helical manner, at least one major vane extending in a continuous helical manner between said teeth, said inner cylinder at its second end having a metallics exit, said exit being partially annular and having a radius less than the diameter of said inner cylinder, any material not passing through the perforations of said attrition chamber leaves said attrition chamber through said metallics exit;

at least one conveying vane provided intermediate said inner cylinder and said outer cylinder for longitudinal movement of any particulate matter deposited therein generally in the opposite direction of lump material within said inner cylinder;

at least one screen at least partially surrounding said intake chamber, said particulate matter moved by said conveying vane being deposited onto said at least one screen for further classification of the particular matter, the matter remaining on the screen being recycled back into the intake compartment; and, a base incorporating drive means supporting the drum and driving the drum in rotation.

2. The rotary tumbler of claim 1 further comprising:

said teeth within said intake compartment having at least one longitudinal vane thereon.

3. The rotary tumbler of claim 1 further comprising:

said teeth within said attrition chamber having serrations thereon opposite said inner surface.

4. The rotary tumbler of claim 1 further comprising:

a fine screen at least partially surrounding said intake chamber generally proximate said second compartment; and, a course screen at least partially surrounding said intake chamber generally outwardly of said fine screen;

said fine screen and said course screen both remove certain sizes of particulate matters through separated collection means for reuse and recycling.

5. The rotary tumbler of claim 1 further comprising:

said slotted disc having a central opening, said central opening having a plurality of radial teeth about the circumference of said central opening, a plurality of annular slots about the circumference of said slotted disc, and each pair of annular slots being spaced apart by a strut, each of said struts extending inwardly from the circumference of said slotted disc to the circumference of said central opening;

wherein said slotted disc admits smaller pieces of lump material through said slots for immediate crushing by said tail and admits larger pieces of lump material over said teeth of said central opening for immediate crushing by said head.

6. The rotary tumbler of claim 1 wherein said crusher occupies approximately the entire diameter of said inner cylinder.

7. The rotary tumbler of claim 1 further comprising:

said teeth upon said head of said crusher having at least one longitudinal vane thereon.

8. The rotary tumbler of claim 1 further comprising:

said teeth upon said head of said crusher having a generally helical arrangement guiding larger lump material following crushing by said head towards said tail for further crushing.

* * * * *